US007370595B1

(12) United States Patent
Ahlquist

(10) Patent No.: US 7,370,595 B1
(45) Date of Patent: May 13, 2008

(54) WATERCRAFT HULL AND GUNWALE MOORING GUARD

(76) Inventor: Brad Ahlquist, 1713 Thorburn Drive SE., Airdrie, Alberta (CA) T4A 2E6

( * ) Notice: Subject to any disclaimer, the term of this patent is extended or adjusted under 35 U.S.C. 154(b) by 0 days.

(21) Appl. No.: 11/622,331

(22) Filed: Jan. 11, 2007

(51) Int. Cl.
*B63B 59/02* (2006.01)

(52) U.S. Cl. ..... 114/219; 405/215

(58) Field of Classification Search ..... 114/219, 114/230.26; 405/211, 212, 215, 216; 267/140
See application file for complete search history.

(56) References Cited

U.S. PATENT DOCUMENTS

| | | | | |
|---|---|---|---|---|
| 2,873,712 | A * | 2/1959 | Gossen | 114/230.24 |
| 3,486,342 | A | 12/1969 | Aks | |
| 3,842,779 | A | 10/1974 | Jaynes | |
| 4,227,832 | A * | 10/1980 | Leone et al. | 405/215 |
| 5,007,363 | A | 4/1991 | James | |
| 5,102,265 | A | 4/1992 | Dokmo et al. | |
| 5,113,702 | A | 5/1992 | Capps | |
| 5,184,562 | A | 2/1993 | Hallin | |
| 5,762,016 | A | 6/1998 | Parsons | |
| 6,685,395 | B1 * | 2/2004 | Busby | 405/215 |
| 6,739,011 | B1 | 5/2004 | Brouillette | |
| 7,066,102 | B1 | 6/2006 | Tossavainen | |
| 2006/0049558 | A1 * | 3/2006 | Cowey | 267/140 |

FOREIGN PATENT DOCUMENTS

| | | |
|---|---|---|
| GB | 2270664 | 3/1994 |

* cited by examiner

*Primary Examiner*—Lars A. Olson
(74) *Attorney, Agent, or Firm*—Marey Law Offices, PLLC; Stephen Lewellyn

(57) ABSTRACT

A watercraft hull and gunwale mooring guard for attachment to a mooring structure to prevent abrasion damage to the contact surfaces of a moored watercraft. The mooring guard includes a stationary vertical guide rod that is attached at one end to a mooring structure at an spaced horizontal distance therefrom and extends vertically upward above the mooring structure. A traveler member is slidable attached to the guide rod which when movement of the water causes the watercraft to move up and down, the traveler in contact with the watercraft will correspondingly move up and down and thus prevent hull and gunwale abrasion, scuffing and damage to the watercraft.

16 Claims, 4 Drawing Sheets

WATERCRAFT HULL AND GUNWALE MOORING GUARD

FIELD OF THE INVENTION

The present invention relates generally to a watercraft mooring guard, and more particularly, a watercraft hull and gunwale guard for attachment to a watercraft mooring structure, such as a dock and the like, to protect the hull and gunwale of a watercraft and the mooring structure on which the guard is attached from damage as a result of the watercraft rising and lowering due to waves and tidal changes.

BACKGROUND OF THE INVENTION

Watercraft typically have a gunwale molding around the upper edge of the hull to provide a contact surface against which a mooring structure can rub without damaging the watercraft. However, other surfaces of the watercraft, such as the hull also typically rub against the mooring structure which results in damage to the gel-coat and costly graphic designs placed on the hull. In an attempt to minimize damage to the hull boaters typically use portable bumpers which are either suspended from the mooring structure or the watercraft in an effort to keep the bumper between the watercraft and the mooring structure. While the bumpers are effective in protecting the hull and mooring structure from impact between the watercraft and mooring structure, the bumpers rub against the hull and gunwale and wear down the gel-coat and expensive graphics placed on the hull as a result of the watercraft rising and lowering due to wave action and tidal changes. As such there exists and need for a gunwale and hull guard for attachment to a mooring structure, which substantially departs from the prior art, and in doing so provides an apparatus primarily developed for the purpose of protecting a watercraft hull and gunwale from rubbing damage as a result of the watercraft rising and lowering due to wave action and tidal changes.

SUMMARY OF THE INVENTION

In general, in one aspect, a watercraft gunwale and hull mooring guard for attachment to a mooring structure is provided. The mooring guard includes a rigid vertical guide member having opposed first and second ends; means for securing the vertical guide member to a dock or the like such that the vertical guide member is positioned outwardly of the dock at a spaced distance; and a traveler member vertically slidable along the vertical guide member, the traveler member having opposed first and second ends, the second end thereof extending beyond the second end of the vertical guide member, whereby when a watercraft moored to the dock rises and falls due to the action of the water and when the watercraft bears against the traveler member the traveler member will move up and down relative to the vertical guide member with the movement of the watercraft and prevent scuffing and damage to the hull and gunwale of the watercraft.

In general, in another aspect, a watercraft mooring system for attachment to a watercraft mooring structure, such as a dock or the like, to prevent scuffing the gunwale and hull of a watercraft moored to the mooring structure as the watercraft moves up and down due to the action of the water is provided. The mooring system includes at least two mooring guards attached to a common surface of a dock at a spaced distance along the dock that is less than the total length of a watercraft moored to the dock. Each of the at least two mooring guards including a rigid vertical guide member having opposed first and second ends; means for securing the vertical guide member to a dock or the like such that the vertical guide member is positioned outwardly of the dock at a spaced distance; and a traveler member vertically slidable along the vertical guide member, the traveler member having opposed first and second ends, the second end thereof extending beyond the second end of the vertical guide member, whereby when a watercraft moored to the dock rises and falls due to the action of the water and when the watercraft bears against the traveler member the traveler member will move up and down relative to the vertical guide member with the movement of the watercraft and prevent scuffing and damage to the hull and gunwale of the watercraft.

There has thus been outlined, rather broadly, the more important features of the invention in order that the detailed description thereof that follows may be better understood and in order that the present contribution to the art may be better appreciated.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DETAILED DESCRIPTION OF THE INVENTION

Figure 1:
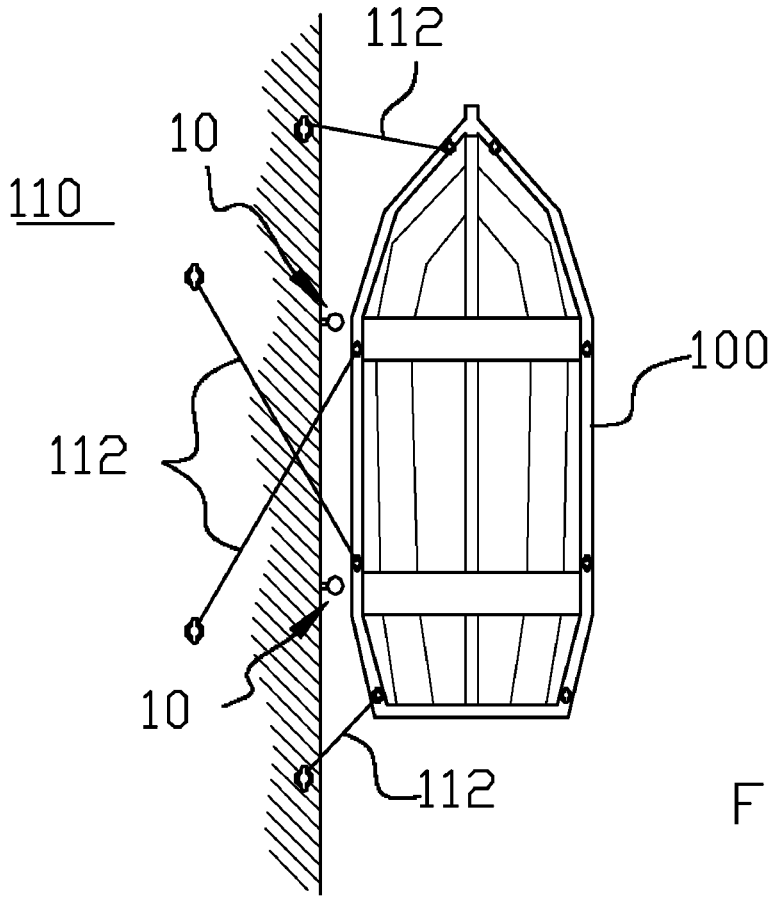
FIG. 1 is a plan view of a conventional mooring arrangement illustrating the hull and gunwale mooring guard embodied by the present invention in use.

Referring now to FIGS. 1-7 of the drawings, reference numeral 10 generally designates gunwale and hull mooring guard of the present invention. With particular reference to FIG. 1 a schematic plan view is showing a typical mooring arrangement whereby a watercraft 100 is secured to a mooring structure 110, such as a dock or the like. The watercraft 100 is held in position adjacent the dock 110 by one or more mooring lines 112. One or more mooring guards 10 are attached along the mooring structure 110 at a spaced distance such that the space between consecutive mooring guards is less than the length of the watercraft 100. While only two mooring guards 10 are shown along the dock 110 having a spacing which spans approximately the length of the watercraft 100, more than two could be utilized along this same distance. It is further recommend for larger watercrafts that more than two mooring guards 10 are used and are equally spaced along the mooring structure to accommodate the length of the watercraft.

Figure 2:
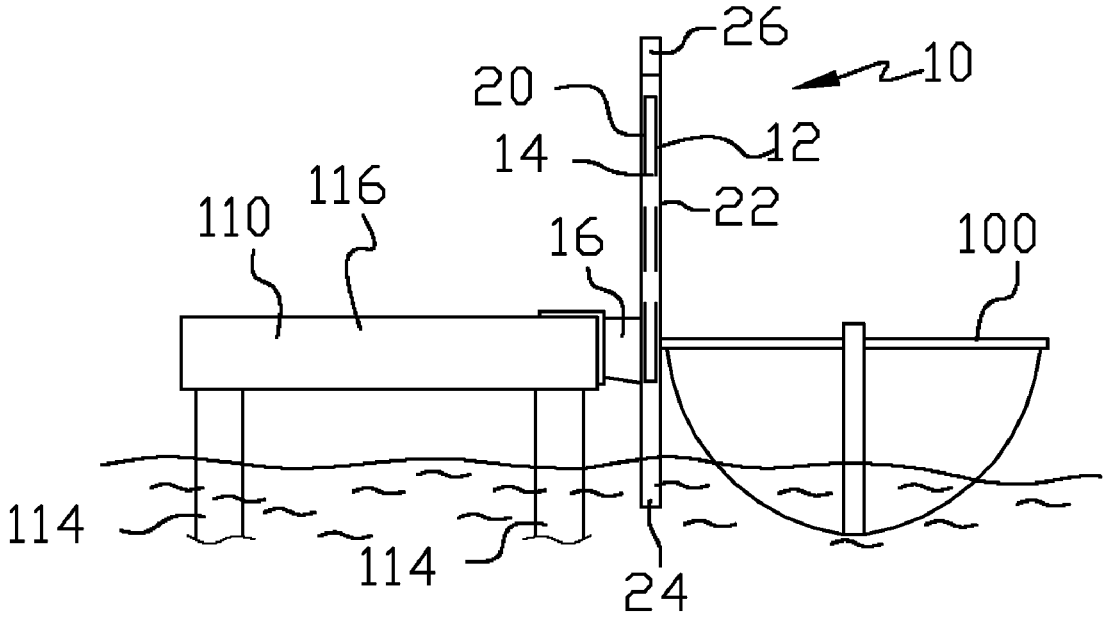
FIG. 2 is an end elevation showing the mooring arrangement of FIG. 1.

With continued reference to FIG. 1 and further reference to FIG. 2, the principles of the mooring guard 10 embodied by the present invention will be described. The mooring guard 10 is attached to the mooring structure 110, which is depicted as a dock or jetty having a plurality of piles 114 supporting a walkway 116. It is important to note, the mooring guard 10 can be utilized with virtually any mooring structure to which a watercraft can be moored, and should not be limited to use with a dock having the particular construction as illustrated.

The mooring guard 10 is affixed to the dock 110 in a manner such that the mooring guard is positioned between the dock and the watercraft 100 moored to the dock. A traveler member 12 is vertically slidable along a vertical guide rod 14 which is securely attached to the dock 110 by a mounting member 16. While the watercraft 100 is moored to the dock 110 and as it is caused to rise and fall due to wave action and press or bear against the traveler member 12, the traveler member will move up and down on the vertical guide rod 14 in concert with the movement of the watercraft and prevent scuffing damage to the contact surfaces of the watercraft, such as the gunwale and hull. The forgoing generally describes the operation of the mooring guard 10 and will be followed by a more detailed description of the component elements.

Figure 3:
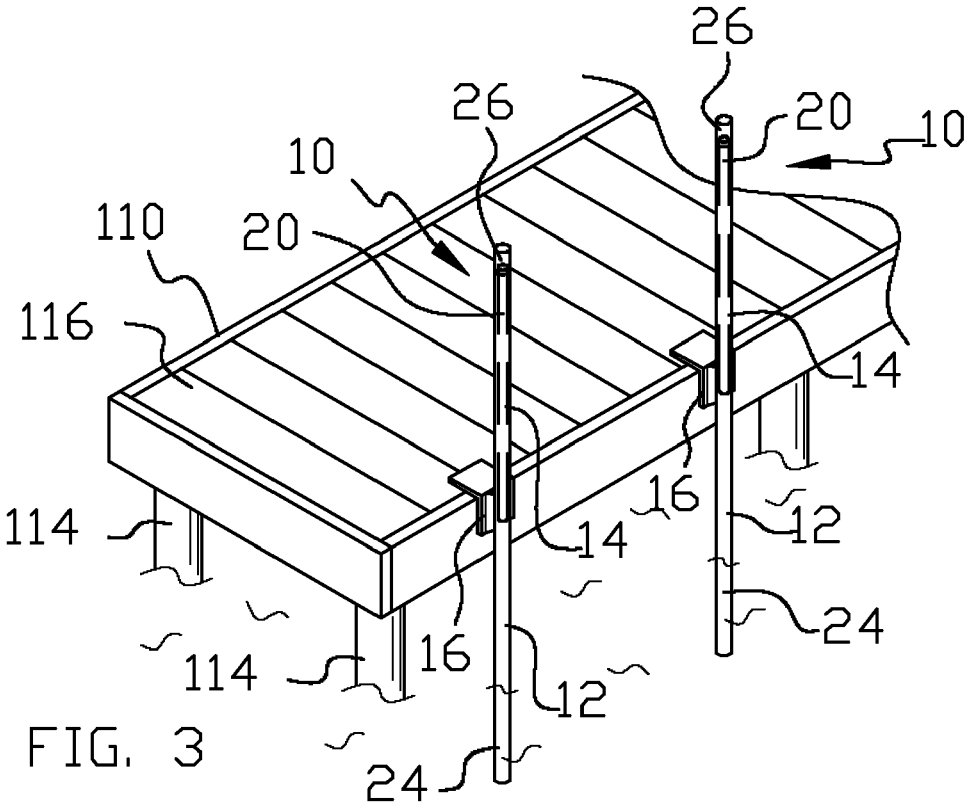
FIG. 3 is a perspective view illustrating a first mounting arrangement of the mooring guard.
Figure 4:
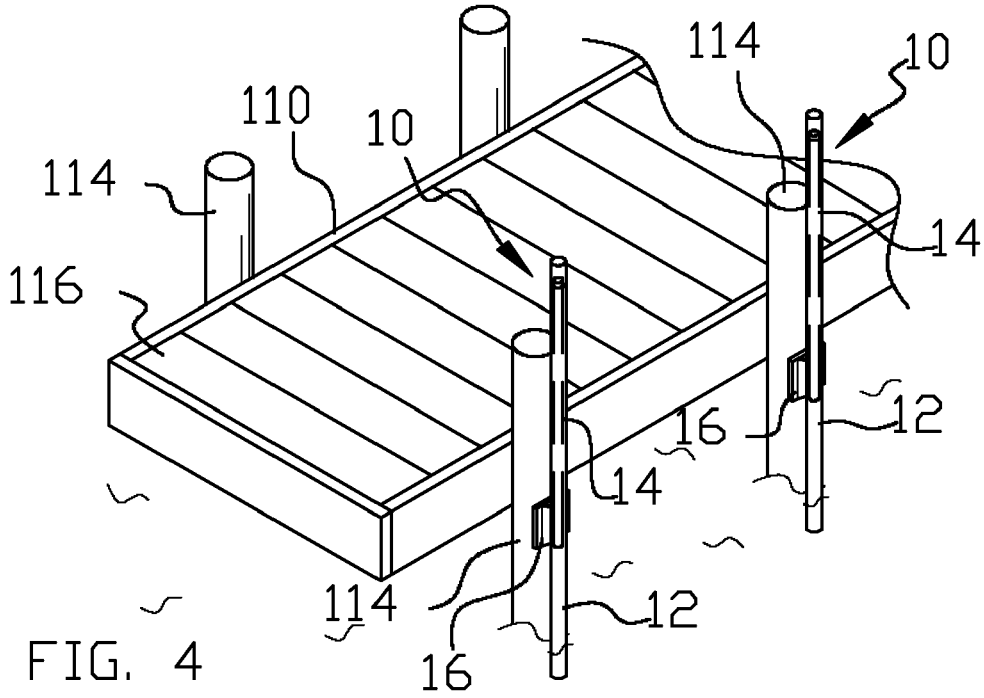
FIG. 4 is a perspective view illustrating a second mounting arrangement of the mooring guard.

With reference to FIG. 3, the mooring guard 10 is securely attached to the dock 100 at an outward horizontally spaced distance therefrom by the mounting member 16. The mounting member 16 can be affixed to the dock 100 using threaded fasteners or the like or by welding if the dock permits such a fastening method. In this particular arrangement, the dock 100 is constructed such that the piles 114 support the walkway 116 from below, and the mounting member 16 is affixed to the side and/or top of the dock 100. Another possible mounting arrangement is shown in FIG. 4, where the dock 100 is constructed such that the walkway 116 is suspended from the inner perimeter of the piles 114. In such a construction, the mounting member 16 is secured to a pile 114 as opposed to the walkway 114 as in the previous example. It is important to note, these examples only illustrate a couple of select mountings of numerous possible mountings. The particular construction of the mooring structure 100 would primarily dictate the mounting of the mooring guard 10 to the same.

The vertical guide rod 14 is attached approximate one end 18 to the mounting member 16 and extends vertically upward above the dock 100 and terminates at an opposed end 20. The vertical guide rod 14 is rigid and is resistant to bending. The vertical guide rod 14 is formed from a corrosion resistant material, such as aluminum or stainless steel or any other corrosion resistant material suitable for the type of environment where the mooring guard 10 is to be located.

The traveler member 12 may comprise a tubular body 22 made of plastic or fiberglass material or the like. The body 22 has opposed first and second ends 24 and 26 and defines an axial bore 28 that extends through the first end 24 and substantially the length of the body towards the second end 26. The traveler member 12 is supported on the guide rod 14 by inserting the guide rod into the axial bore 28 through the first end 24. The traveler member 12 is vertically slidable along the guide rod 14 from a lower most position to an upper most position. The first end 24 of the traveler member 12 extends beyond the lower end 18 of the guide rod 14. It is preferred the first end 24 of the traveler member 12 to continue to extend beyond the lower end 18 of the guide rod 14 as it slides up and down on the guide rod between the lower most and upper most positions. Further, it is preferred the first end 24 at least partially extends below the surface of the water when at least in the lower most position, as best shown in FIG. 2. The traveler member 12 is of a length that it will engage the side of the watercraft 100 so that any portion of the side of the watercraft that comes into contact with the traveler member will at all times contact the traveler member and no portion will directly contact the guide rod 14, the mount member 16 or the dock 110.

Figure 5:
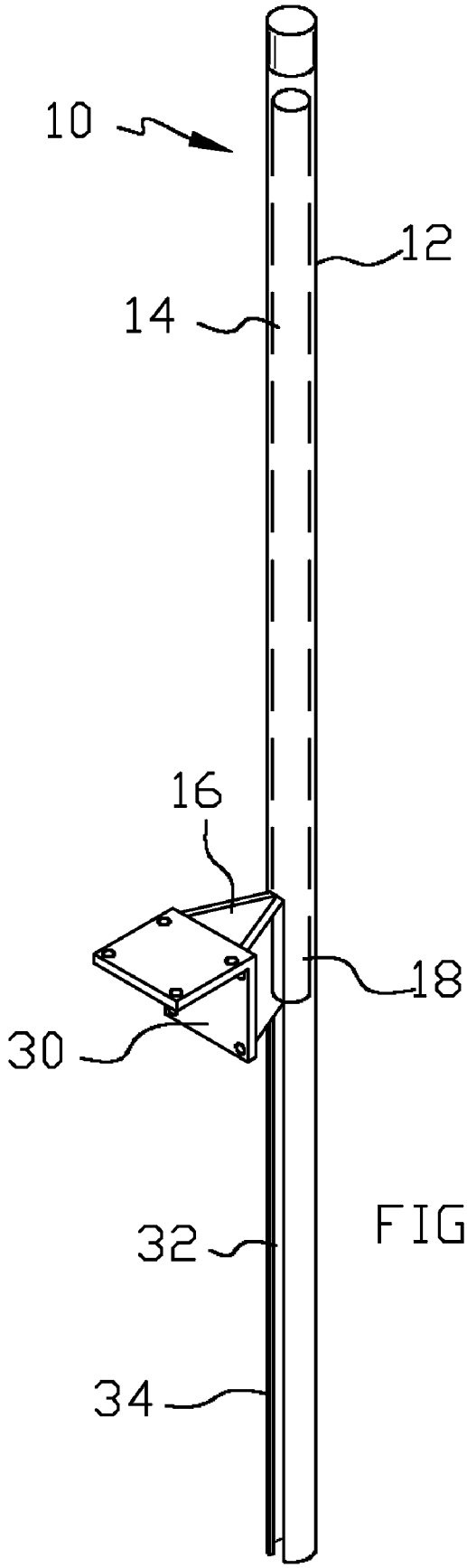
FIG. 5 is a rear perspective view of the mooring guard embodied by the present invention.
Figure 6:
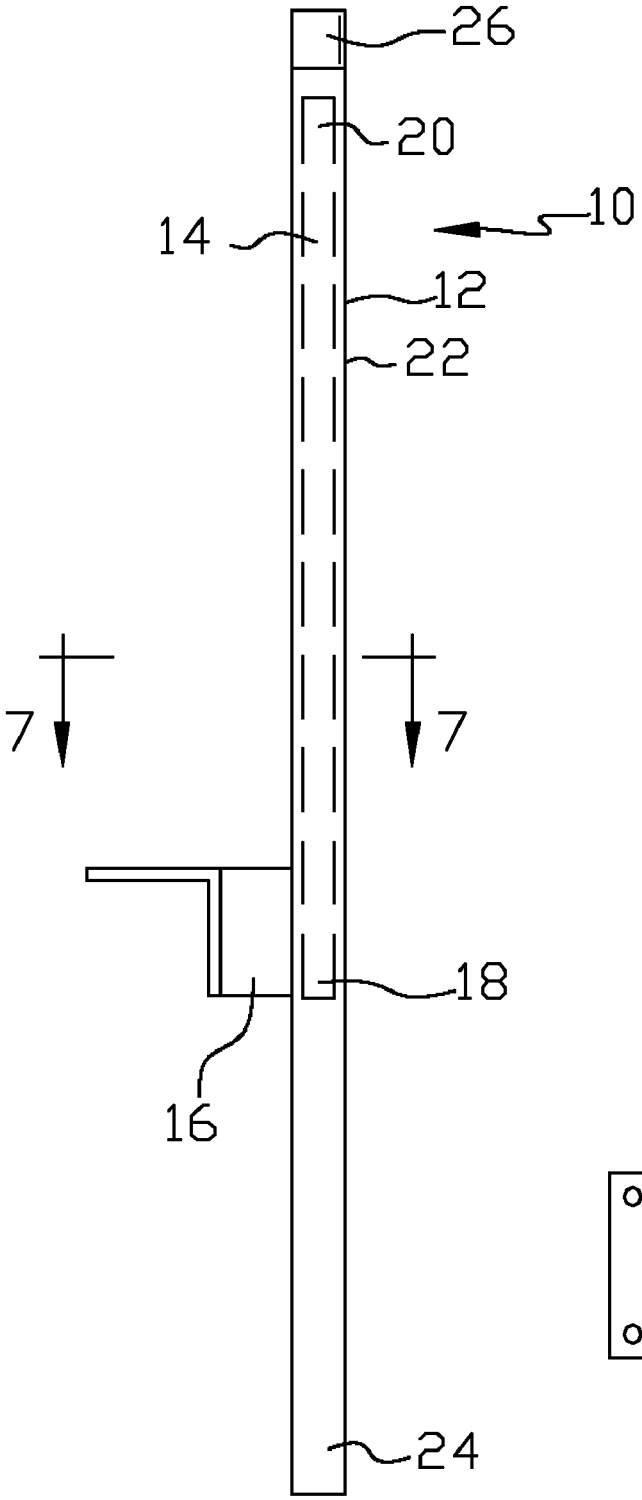
FIG. 6 is a side elevation view of the mooring guard embodied by the present invention.
Figure 7:
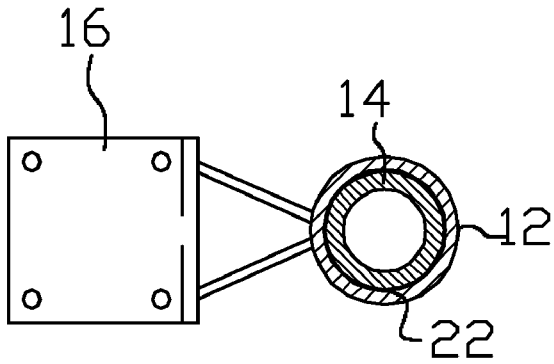
FIG. 7 is sectional view taken along line 7-7 in FIG. 6.

With particular reference to FIG. 5, the mounting member 16 is attached to the guide rod 14 approximate the end 18 and extends rearwardly outward therefrom and terminates at a mounting surface 30. A rearward facing surface 32 of the traveler member 12 includes a vertical slot 32 through which the mounting member 16 extends. The vertical slot 34 is formed through the rearward facing surface 32 from the first end 24 of the traveler member to an intermediate position along therealong. The vertical slot 32 permits the first end 24 of the traveler member 12 to slide past the mounting member 16.

A light reflecting element 36 can be attached to the traveler member 12 to aid in mooring the watercraft 100 to the dock 110. Preferably, the light reflecting element 36 is attached approximate the second end of the traveler member 12 so as not be obscured by the dock structure.

It can be readily seen, a watercraft moored to a dock having attached thereto the mooring guard forming this invention and when there is movement of the water due to waves and the sides of the watercraft bear against, engage or otherwise contact the traveler members and the watercraft moves up and down the traveler members will corresponding move up and down, thereby eliminating and damage to the watercraft.

A number of embodiments of the present invention have been described. Nevertheless, it will be understood that various modifications may be made without departing from the spirit and scope of the invention. Accordingly, other embodiments are within the scope of the following claims.

I claim:

1. A watercraft gunwale and hull mooring guard for attachment to a mooring structure, the mooring guard comprising:

a rigid vertical guide member having opposed first and second ends;

means for securing said vertical guide member to a mooring structure such that said vertical guide member is positioned outwardly of the mooring structure at a spaced distance; and a traveler member vertically slidable along said vertical guide member beyond said first and said second ends of said vertical guide member, said traveler member having opposed first and second ends, said second end thereof extending beyond said second end of said vertical guide member, whereby when a watercraft moored to the mooring structure rises and falls due to the action of the water and when the watercraft bears against said traveler member said traveler member will move up and down relative to said vertical guide member with the movement of the watercraft and prevent scuffing and damage to the hull and gunwale of the watercraft.

2. The mooring guard of claim 1, wherein said second end of said traveler member at least partially extends below the surface of the water.

3. The mooring guard of claim 1, wherein said vertical guide member is cylindrically shaped and said traveler member is tubular shaped and further wherein said vertical guide member is received by said traveler member and is co-axially aligned therewith.

4. The mooring guard of claim 3, wherein the substantial length of said vertical guide member is received by said traveler member.

5. The mooring guard of claim 1, further comprising:

a light reflecting member attached to said traveler member.

6. A watercraft gunwale and hull mooring guard for attachment to a mooring structure, the mooring guard comprising:

a rigid vertical guide member having a cylindrically shaped body with opposed first and second ends;

means for securing said second end of said vertical guide member to a mooring structure such that said vertical guide member is positioned outwardly of the mooring structure at a spaced distance; and a traveler member having a tubular body with opposed first and second ends is vertically slidable along said vertical guide member, said second end of said traveler member extending beyond said second end of said vertical guide member, whereby when a watercraft moored to the mooring structure rises and falls due to the action of the water and when the watercraft bears against said traveler member said traveler member will move up and down relative to said vertical guide member with the movement of the watercraft and prevent scuffing and damage to the hull and gunwale of the watercraft.

7. The mooring guard of claim 6, wherein said second end of said traveler member at least partially extends below the surface of the water.

8. The mooring guard of claim 6, wherein the substantial length of said vertical guide member is received by said traveler member.

9. The mooring guard of claim 6, further comprising:

a light reflecting member attached to said traveler member.

10. The mooring guard of claim 6, wherein said traveler member has a rearward facing surface and a vertical slot formed through said rearward facing surface from said second end of said traveler member to a position intermediate of said second and first ends thereof, and further wherein said means for securing said vertical guide extends rearwardly outward from said second end of said vertical guide through said slot and terminates at a mounting surface adapted for attachment to the mooring structure.

11. The mooring guard of claim 10, wherein said second end of said traveler member at least partially extends below the surface of the water.

12. The mooring guard of claim 10, further comprising:

a light reflecting member attached to said traveler member.

13. A watercraft mooring system for attachment to a watercraft mooring structure, to prevent scuffing the gunwale and hull of a watercraft moored to the mooring structure as the watercraft moves up and down due to the action of the water, the mooring system comprising:

at least two mooring guards attached to a common surface of a mooring structure at a spaced distance along the mooring structure that is less than the total length of a watercraft moored to the mooring structure;

each of said at least two mooring guards including:

a rigid vertical guide member having opposed first and second ends;

means for securing said vertical guide member to the mooring structure a or the like such that said vertical guide member is positioned outwardly of the mooring structure at a spaced distance; and a traveler member vertically slidable along said vertical guide member beyond said first and said second ends of said vertical guide member, said traveler member having opposed first and second ends, said second end thereof extending beyond said second end of said vertical guide member, whereby when a watercraft moored to the mooring structure rises and falls due to the action of the water and when the watercraft bears against said traveler member said traveler member will move up and down relative to said vertical guide member with the movement of the watercraft and prevent scuffing and damage to the hull and gunwale of the watercraft.

14. The mooring system of claim 13, wherein said second end of said traveler member at least partially extends below the surface of the water.

15. The mooring system of claim 13, wherein said vertical guide member is cylindrically shaped and said traveler member is tubular shaped and further wherein said vertical guide member is received by said traveler member and is co-axially aligned therewith.

16. The mooring system of claim 13, wherein said traveler member has a rearward facing surface and a vertical slot formed through said rearward facing surface from said second end of said traveler member to a position intermediate of said second and first ends thereof, and further wherein said means for securing said vertical guide extends rearwardly outward from said second end of said vertical guide through said slot and terminates at a mounting surface adapted for attachment to the mooring structure.

* * * * *